US012736066B2

(12) United States Patent
Yin et al.

(10) Patent No.: US 12,736,066 B2
(45) Date of Patent: Sep. 15, 2026

(54) TWO-STAGE JET DEVICE WITH FLOW GUIDE STRUCTURE

(71) Applicant: Jiangsu University, Jiangsu (CN)

(72) Inventors: Bifeng Yin, Jiangsu (CN); Fei Dong, Jiangsu (CN); Hekun Jia, Jiangsu (CN); Zekai Li, Jiangsu (CN); Jie Ni, Jiangsu (CN)

(73) Assignee: Jiangsu University, Jiangsu (CN)

( * ) Notice: Subject to any disclaimer, the term of this patent is extended or adjusted under 35 U.S.C. 154(b) by 188 days.

(21) Appl. No.: 18/844,389

(22) PCT Filed: Nov. 13, 2023

(86) PCT No.: PCT/CN2023/131190
§ 371 (c)(1),
(2) Date: Sep. 6, 2024

(87) PCT Pub. No.: WO2025/000816
PCT Pub. Date: Jan. 2, 2025

(65) Prior Publication Data

US 2026/0185543 A1 Jul. 2, 2026

(30) Foreign Application Priority Data

Jun. 26, 2023 (CN) ..... 202310756133.0

(51) Int. Cl.
*F04F 5/22* (2006.01)
*F04F 5/46* (2006.01)
*F04F 5/52* (2006.01)

(52) U.S. Cl.
CPC ..... *F04F 5/22* (2013.01); *F04F 5/461* (2013.01); *F04F 5/463* (2013.01); *F04F 5/467* (2013.01); *F04F 5/52* (2013.01)

(58) Field of Classification Search
CPC ..... F04F 5/22; F04F 5/461; F04F 5/52
See application file for complete search history.

(56) References Cited

U.S. PATENT DOCUMENTS 5,323,967 A * 6/1994 Tanaka ..... F04F 5/461 239/590.5
2005/0204771 A1* 9/2005 Ogata ..... F25B 41/00 62/500

(Continued)

FOREIGN PATENT DOCUMENTS

CN 203291984 11/2013
CN 114551930 5/2022

(Continued)

OTHER PUBLICATIONS

"International Search Report (Form PCT/ISA/210) of PCT/CN2023/131190", mailed on Mar. 20, 2024, pp. 1-4.

(Continued)

*Primary Examiner* — Reinaldo Sanchez-Medina
(74) *Attorney, Agent, or Firm* — JCIPRNET

(57) ABSTRACT

A two-stage jet device with a flow guide structure includes a cavity and a nozzle. An end of the cavity is provided with a first gas inlet and a second gas inlet, the nozzle includes a first-stage nozzle and a second-stage nozzle, the first-stage nozzle is located in a mixing cavity, the second-stage nozzle is mounted in the first-stage nozzle in an axially movable manner, and the second gas inlet is in communication with a first jet channel or two jet channels by moving the second-stage nozzle; the jet device further includes guide vanes, the guide vanes are arranged in the first gas inlet and a suction cavity of the mixing cavity respectively, the guide vane in the suction cavity is rotatable, and a control system controls a rotation angle of the guide vane in the suction cavity according to a position of the second-stage nozzle.

7 Claims, 8 Drawing Sheets

(56) References Cited

U.S. PATENT DOCUMENTS

| | | | | |
|---|---|---|---|---|
| 2018/0073523 | A1* | 3/2018 | Brunner | F04F 5/461 |
| 2019/0338790 | A1* | 11/2019 | Suzuki | F25B 41/00 |
| 2022/0381181 | A1* | 12/2022 | Briley | F02C 9/18 |
| 2024/0159251 | A1* | 5/2024 | Zhang | F04F 5/463 |
| 2025/0271004 | A1* | 8/2025 | Plummer | F04F 5/18 |

FOREIGN PATENT DOCUMENTS

| | | |
|---|---|---|
| CN | 116123153 | 5/2023 |
| CN | 116480636 | 7/2023 |
| WO | 2022183323 | 9/2022 |

OTHER PUBLICATIONS

"Written Opinion of the International Searching Authority (Form PCT/ISA/237) of PCT/CN2023/131190", mailed on Mar. 20, 2024, pp. 1-4.

* cited by examiner

TWO-STAGE JET DEVICE WITH FLOW GUIDE STRUCTURE

CROSS-REFERENCE TO RELATED APPLICATION

This application is a 371 of international application of PCT application serial no. PCT/CN2023/131190 filed on Nov. 13, 2023 which claims the priority benefit of China application no. 202310756133.0 filed on Jun. 26, 2023. The entirety of each of the above mentioned patent applications is hereby incorporated by reference herein and made a part of this specification.

TECHNICAL FIELD

The present disclosure relates to the field of jet devices or fuel cells, and in particular, to a two-stage jet device with a flow guide structure.

DESCRIPTION OF RELATED ART

As an efficient electrochemical energy conversion device, a proton exchange membrane fuel cell takes hydrogen as fuel, generates water through a reaction, has a power generation efficiency not limited by a Carnot cycle, and meets requirements of future society for efficient, clean, and economic energy systems. In order to realize high-efficiency operation of a fuel cell system, the hydrogen is excessively supplied to a fuel cell stack by a hydrogen supply system, and therefore, the hydrogen which passes through the stack but does not react is required to be recycled to improve the efficiency thereof.

Currently, a circulating pump is mostly adopted to recycle the hydrogen in a hydrogen circulating system, but the hydrogen circulating pump is required to achieve the performances of sealing, low-temperature cold starting, and vibration and noise reduction. As a pure mechanical structure, a jet device drives jet gas to recirculate using a pressure difference and a viscous shearing action, has the advantages of no extra parasitic loss and low working noise, and is thus widely applied to design of the hydrogen circulating system.

However, in most of existing jet device inventions, a first gas inlet pipe and a second gas inlet pipe are generally arranged vertically, and for the purpose of making high-velocity flow gas approach a mixing cavity as much as possible to increase a circulation efficiency, an outlet of a second gas inlet is generally designed to move forwards, but a cross section of an outlet of a second gas inlet nozzle and a cross section of the first gas inlet pipe are intersected to cause the defect of a reduced flow area, such that part of jetted gas collides with a side wall surface of the nozzle before entering the mixing cavity to form a vortex, thereby reducing an effective entrainment amount of the jetted gas; meanwhile, due to the perpendicular relationship of the above geometric structure, when entering the mixing cavity, the jetted gas directly enters a high-velocity flow of the outlet of the second gas inlet nozzle at an approximately perpendicular angle, such that the two gas flows have a stronger collision to cause great kinetic energy loss and meanwhile generate a circumferential gas flow fluctuation, thus causing an unstable mixing flow phenomenon at a front end of the mixing cavity. A gas flow velocity at the front end of the mixing cavity is reduced, and meanwhile, a turbulent fluctuation influences a motion state of a boundary layer thereof, the influence of the gas flow fluctuation is transmitted to the isovolumetric mixing cavity, an energy mixing process of primary flow gas and secondary flow gas cannot be completed under a fixed structure, unstable gas moves to a diffusion pipe to influence a diffusion effect and an outlet pressure of the jet device, and thus influence a supply pressure of the stack, and an optimal output efficiency of each working condition point of a fuel cell stack system cannot be achieved.

SUMMARY

In view of the deficiencies in the prior art, the present disclosure provides a two-stage jet device with a flow guide structure, where a first jet channel and a second jet channel are arranged, such that different jet channels can be selected according to output power of a fuel cell; an end of a second-stage nozzle extends out of an end surface of a first-stage nozzle to achieve an effect of axial steps of outlets of the two jet channels, so as to prevent an unstable phenomenon of a vortex, oscillation, or the like, caused by simultaneous mixing of multiple gas flows at a front end of a multi-channel jet device. Meanwhile, in the present disclosure, guide vanes are arranged in a first gas inlet and an isobaric mixing cavity, a second nozzle is horizontally moved according to output power of a stack, and meanwhile, rotation of a rotary guide vane in a suction cavity is controlled cooperatively, such that secondary flow gas enters primary flow gas at an optimal angle, and primary flow shear stress is utilized to a maximum degree to guide the gas flows to gently meet. Gas in the outlets of the jet channels is uniformly mixed and meanwhile kept at a high velocity, to reduce energy loss, and the gas stably enters a mixing cavity and a diffusion cavity at a high velocity and is stably supplied to the stack.

The above technical objective of the present disclosure is attained with the following technical means.

A two-stage jet device with a flow guide structure includes a cavity and a nozzle, where a first end of the cavity is provided with an outlet, a second end of the cavity is provided with a first gas inlet and a second gas inlet, and a mixing cavity in communication with the first gas inlet is formed in the cavity; the nozzle includes a first-stage nozzle and a second-stage nozzle, the first-stage nozzle is located in the mixing cavity, and the first-stage nozzle is mounted at the second end of the cavity; the second-stage nozzle is mounted in the first-stage nozzle in an axially movable manner, an end of the second-stage nozzle is inserted into an inner cavity of the first-stage nozzle, a space between a shell of the second-stage nozzle and the inner cavity of the first-stage nozzle is a first jet channel, and a central hole in the second-stage nozzle is a second jet channel; the second gas inlet is in communication with the first jet channel, or with the first jet channel and the second jet channel by moving the second-stage nozzle;

the two-stage jet device further includes guide vanes, the guide vanes are arranged in the first gas inlet and a suction cavity of the mixing cavity respectively, one of the guide vanes in the suction cavity is rotatable, and a control system controls a rotation angle of the one of the guide vanes in the suction cavity according to a position of the second-stage nozzle.

Further, the guide vanes include a first fixed guide vane, a second fixed guide vane, and a rotary guide vane; the first fixed guide vane and the second fixed guide vane are arranged in the first gas inlet, the first fixed guide vane is parallel to a cross section of the first gas inlet, and the second fixed guide vane is perpendicular to the cross section of the first gas inlet; the rotary guide vane is located between the first-stage nozzle and a wall surface of the suction cavity, an end of the rotary guide vane is hinged to the wall surface of the suction cavity, and the rotary guide vane is rotatable by an external force.

Further, a thickness of the first fixed guide vane is 0.15 times to 0.18 times a nominal diameter of the first gas inlet; an inlet edge of the first fixed guide vane is circular, and an outlet of the first fixed guide vane is arc-shaped; an inner diameter of the circle at an inlet of the first fixed guide vane is the same as the thickness of the first fixed guide vane; and an arc-shaped intersection point at the outlet of the first fixed guide vane is located on a center line at the outlet of the first fixed guide vane.

Further, a thickness of the second fixed guide vane is 0.6 times to 0.8 times the nominal diameter of the first gas inlet; an inlet edge of the second fixed guide vane is circular, and an outlet of the second fixed guide vane is arc-shaped; an inner diameter of the circle at an inlet of the second fixed guide vane is the same as the thickness of the second fixed guide vane; and an arc-shaped intersection point at the outlet of the second fixed guide vane is located on a center line at the outlet of the second fixed guide vane.

Further, a tip of an arc shape of the outlet of the first fixed guide vane is close to a center of a curvature side of the second fixed guide vane, a distance from the tip of the arc shape of the outlet of the first fixed guide vane to a circle center of the curvature side of the second fixed guide vane is 0.3 times to 0.4 times the nominal diameter of the first gas inlet, a tip of the arc shape of the outlet of the second fixed guide vane is close to a turning point of a tapered housing of the first-stage nozzle, and a minimum distance from the tip of the arc shape of the outlet of the second fixed guide vane to the tapered housing of the first-stage nozzle is 0.03 times to 0.05 times the nominal diameter of the first gas inlet.

Further, a thickness of the rotary guide vane is 0.5 times to 0.7 times a minimum diameter of the suction cavity; an inlet edge of the rotary guide vane is circular, and the outlet of the second fixed guide vane is arc-shaped and in a flat needle shape; an inner diameter of the circle at an inlet of the rotary guide vane is the same as the thickness of the second fixed guide vane; and an arc-shaped intersection point at the outlet of the rotary guide vane is located on a center line at the outlet of the rotary guide vane.

Further, the end of the second-stage nozzle extends out of an end surface of the first-stage nozzle to prevent a vortex from being generated at an outlet of the nozzle; a distance from the end of the second-stage nozzle extending out of the end surface of the first-stage nozzle to a cross section of an outlet of the suction cavity is NXP, NXP is $0.8D_m$ to $1.1D_m$, and $D_m$ is a nominal diameter of the outlet of the suction cavity.

Further, a housing of the second-stage nozzle is sequentially provided with a first housing section, a second housing section, and a guide end according to a flow direction; the guide end is inserted into the first-stage nozzle, such that a cross section of an outlet of the first jet channel is annular; an end of the guide end extends out of the end surface of the first-stage nozzle; an outer contour surface of the guide end is sequentially provided with a first flow guide surface and a third flow guide surface according to the flow direction, a smooth transition exists between a side of the first flow guide surface and the second housing section, and gas in the outlet of the first jet channel is kept horizontally advancing by applying a supporting force to the gas in the outlet of the first jet channel; an inner hole of the guide end at the outlet of the second jet channel is provided with a second flow guide surface, and gas in the outlet of the second jet channel is kept horizontally advancing before mixed in the first jet channel and the second jet channel by radially shunting and constraining the gas in the outlet of the second jet channel; the third flow guide surface is a tapered conical surface, and mixed gas formed by the gas in the outlet of the second jet channel and gas entering the mixing cavity obliquely enters the gas in the outlet of the first jet channel along the third flow guide surface, to moderate mixing of the mixed gas and the gas in the outlet of the second jet channel.

Further, an inclination angle of the third flow guide surface increases with an axial length of the guide end; and an included angle between the third flow guide surface and an axial direction is 8 degrees to 15 degrees.

Further, a diffusion section is provided at an outlet of the second flow guide surface, a taper of an inner contour of the diffusion section is a positive taper θ, and a taper of the third flow guide surface is larger than the taper of the inner contour of the diffusion section.

The present disclosure has the advantages as follows.

1. In the two-stage jet device with the flow guide structure according to the present disclosure, the guide vanes are arranged in the first gas inlet and the isobaric mixing cavity, the second nozzle is horizontally moved according to the output power of the stack, and meanwhile, the rotation of the rotary guide vane in the mixing cavity is controlled cooperatively, such that the secondary flow gas enters the primary flow gas at the optimal angle, and the primary flow shear stress is utilized to the maximum degree to guide the gas flows to gently meet; the gas in the outlets of the jet channels is uniformly mixed and meanwhile kept at the high velocity, so as to reduce the energy loss, and the gas stably enters the mixing cavity and the diffusion cavity at the high velocity and is stably supplied to the stack.
2. In the two-stage jet device with the flow guide structure according to the present disclosure, the fixed guide vane is arranged at the first gas inlet, and the outlet of the fixed guide vane is arranged corresponding to an inlet of an inclined structure of the first-stage nozzle, such that the fixed guide vane can efficiently collect and guide the gas in the first gas inlet, so as to reduce loss of the gas in a first gas inlet channel, reduce loss of the gas entering the mixing cavity to a greatest extent, and meanwhile accelerate gas flowing to a certain extent.
3. In the two-stage jet device with the flow guide structure according to the present disclosure, the arc-shaped rotary guide vane is arranged at a center between the first-stage nozzle and the wall surface of the isobaric mixing cavity and corresponds to a taper center of the third flow guide surface. In actual working, when the second-stage nozzle advances horizontally, an angle of a magnetic field is changed to drive a revolute pair where the rotary guide vane is located to rotate towards a positive direction of the axial direction; when the second-stage nozzle horizontally retreats, the angle of the magnetic field is changed to rotate the rotary guide vane towards a negative direction of the axial direction, an optimal bending direction is realized in cooperation with the taper of the third flow guide surface, an inflow direction of the first gas inlet is improved, and a mass flow rate of an effective inflow is improved, thereby improving a circulation efficiency of the jet device.
4. In the two-stage jet device with the flow guide structure according to the present disclosure, the end of the second-stage nozzle extends out of the end surface of the first-stage nozzle to achieve the effect of the axial steps of the outlets of the two jet channels, so as to prevent the unstable phenomenon of the vortex, the oscillation, or the like, caused by the simultaneous mixing of the multiple gas flows at the front end of the multi-channel jet device. The distance from the end of the second-stage nozzle extending out of the end surface of the first-stage nozzle to the cross section of the outlet of the mixing cavity is NXP, and when NXP is $0.8D_m$ to $1.1D_m$, an entrainment effect and a gas flow mixing effect are optimal.

5. In the two-stage jet device with the flow guide structure according to the present disclosure, the guide end is inserted into a spraying section, such that the cross section of the outlet of the first jet channel is annular, the outer contour surface of the guide end is sequentially provided with the first flow guide surface and the third flow guide surface according to the flow direction, and the first flow guide surface applies the supporting force to the gas in the outlet of the first jet channel, so as to keep the gas in the outlet of the first jet channel advancing horizontally; the third flow guide surface is the tapered conical surface, and the mixed gas formed by the gas in the outlet of the second jet channel and the gas entering the mixing cavity obliquely enters the gas in the outlet of the first jet channel along the third flow guide surface to moderate the mixing of the two gas flows. The inner hole of the guide end at the outlet of the second jet channel is provided with the second flow guide surface, and the gas in the outlet of the second jet channel is kept horizontally advancing before mixed in the two jet channels by radially shunting and constraining the gas in the outlet of the second jet channel. The spraying section is a taper hole, the taper of the third flow guide surface and taper of the taper hole of the spraying section are the same and have opposite directions, such that a mixing process of the gas of the two stages of nozzles can be moderated, and a high flow velocity can be maintained when a flow rate of the first gas inlet is low. By the diffusion section at the outlet of the second-stage nozzle, a radial velocity of the jet gas is reduced, the mixing process of the gas in the outlet of the second jet channel, the gas in the outlet of the first jet channel and the jet gas is moderated, the energy loss is reduced, the gas is uniformly mixed by utilizing the gas shear stress, and the gas stably enters the mixing cavity at the high velocity and is stably supplied to the stack.

BRIEF DESCRIPTION OF THE DRAWINGS

In order to more clearly explain the technical solutions of the embodiments of the present disclosure or the prior art, the drawings to be used in the descriptions of the embodiments or the prior art are briefly introduced as follows. The following drawings illustrate some embodiments of the present disclosure, and apparently, a person skilled in the art can obtain other drawings from these drawings without any creative effort.

DESCRIPTION OF THE EMBODIMENTS

Figure 1:
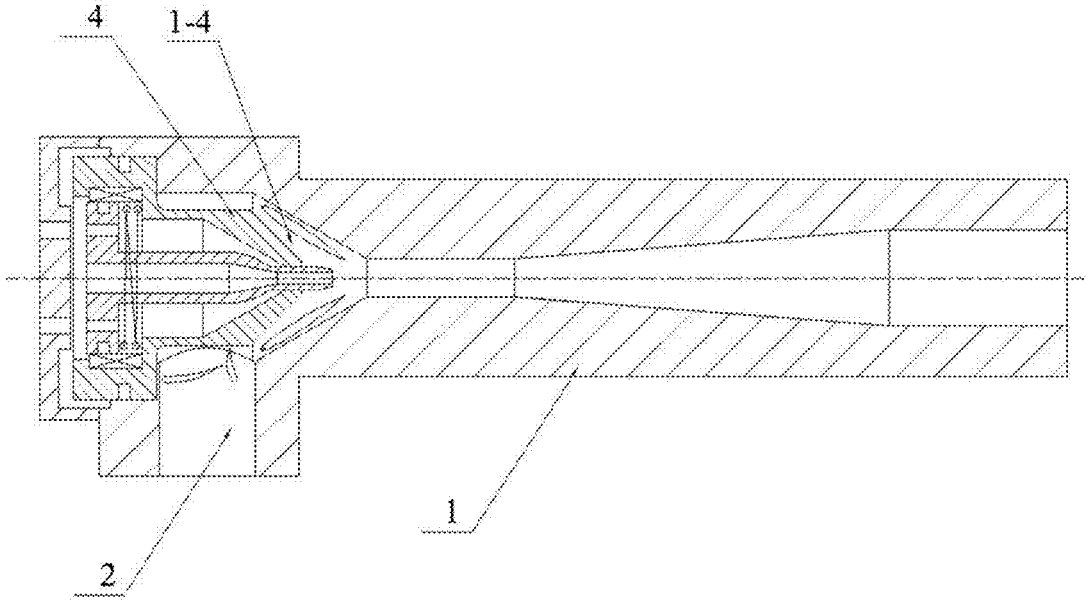
FIG. 1 is an assembly view of a two-stage jet device according to Embodiment 1 of the present disclosure.

Reference will be made in detail to embodiments of the present disclosure, and the examples of the embodiments are illustrated in the drawings, where the same or similar elements and the elements having same or similar functions are denoted by like reference numerals throughout the descriptions. The embodiments described below with reference to drawings are illustrative, and intended for explaining the present disclosure. The embodiments shall not be construed to limit the present disclosure.

In descriptions of the present disclosure, it should be understood that, directions or positional relationships indicated by terms "center", "longitudinal", "transverse", "length", "width", "thickness", "upper", "lower", "axial", "radial", "vertical", "horizontal", "inner", "outer", etc. are based on orientations or positional relationships shown in the accompanying drawings, and they are used only for describing the present disclosure and for description simplicity, but do not indicate or imply that an indicated device or element must have a specific orientation or be constructed and operated in a specific orientation. Therefore, it cannot be understood as a limitation on the present disclosure. In addition, the terms such as "first" and "second" are merely used for purposes of description and are not intended to indicate or imply relative importance or to imply the number of indicated technical features. Thus, the feature defined with "first" and "second" may include one or more of this feature explicitly or implicitly. In the description of the present disclosure, "a plurality of" means two or more unless otherwise specified.

In the present disclosure, unless specified or limited otherwise, the terms "mounted", "connected", "coupled", "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

As shown in FIG. 1, a two-stage jet device with a flow guide structure according to the present disclosure includes a cavity 1, a base 3, a nozzle 4, and guide vanes 5, where a wall surface of the cavity 1 is a housing 1-1, a first end of the cavity 1 is provided with an outlet, a second end of the cavity 1 is provided with a first gas inlet 2, a mixing cavity 1-4 in communication with the first gas inlet 2 is formed in the cavity 1, the nozzle 4 is mounted in the mixing cavity 1-4, 2 independent jet channels are arranged in the nozzle 4, the housing 1-1 is provided with a second gas inlet 1-2 for communication, and the second gas inlet 1-2 is in communication with a first jet channel or the two jet channels by moving the nozzle 4. In the field of fuel cells, the first gas inlet 2 is generally in communication with mixed gas of unreacted hydrogen and water vapor in a stack; the second gas inlet 1-2 is in communication with a hydrogen supply apparatus; an action of a valve core is controlled according to output power of the fuel cell, such that a working performance of the jet device in a wide output power range of the fuel cell can be greatly improved.

The guide vanes 5 include a first fixed guide vane 5-1, a second fixed guide vane 5-2, and a rotary guide vane 5-3, the first fixed guide vane 5-1 and the second fixed guide vane 5-2 are airfoil guide vanes, the first fixed guide vane 5-1 and the second fixed guide vane 5-2 are mounted at an inlet of the first gas inlet 2, an airfoil chord of the first fixed guide vane 5-1 is parallel to a cross section of the inlet of the first gas inlet 2, an airfoil chord of the second fixed guide vane 5-2 is perpendicular to the cross section of the inlet of the first gas inlet 2, and a tip of one end of the first fixed guide vane 5-1 is close to a center of a small curvature side of the second fixed guide vane 5-2, i.e., a center of a back surface of the second fixed guide vane 5-2, such that the first fixed guide vane 5-1 can conveniently collect gas of the first gas inlet 2 and guide the gas into the second fixed guide vane 5-2; a tip of one end of the second fixed guide vane 5-2 is close to a turning point of a tapered shell of a first-stage nozzle 4-1, such that the gas at the first gas inlet 2 can be conveniently guided along a wall surface of the first-stage nozzle 4-1; the rotary guide vane 5-3 is located at a central position between the first-stage nozzle 4-1 and an isobaric wall surface of the mixing cavity 1-4, an end of the rotary guide vane 5-3 is hinged to the wall surface of the mixing cavity 1-4, the rotary guide vane 5-3 is made of a magnetic material, the rotary guide vane 5-3 is rotatable by an external magnetic field, and an angle of the magnetic field is changed according to the output power of the fuel cell, such that forward or reverse rotation of the rotary guide vane 5-3 is controlled to adapt to an optimal incoming angle of the mixed gas entering at an outlet of the first gas inlet 2. Technical terms in the airfoil guide vane are interpreted as follows: an end of an airfoil with a slower curvature change, i.e., a smoother end, is called a leading edge of the airfoil; an end of the airfoil with a rapider curvature change, i.e., a sharper end, is called a trailing edge of the airfoil. An airfoil contour line includes an upper smooth curve and a lower smooth curve, a convex surface is defined as a back surface, a concave surface is defined as a working surface, a series of infinite inscribed circles are sequentially made between the two surfaces, and a curve formed by circle centers of the inscribed circles is called a skeleton line of the airfoil. Two endpoints of the skeleton line are connected by a straight line called the airfoil chord. A distance between the convex surface and the concave surface of the airfoil in a normal direction of the skeleton line is called a thickness.

Embodiment 1

Figure 2:
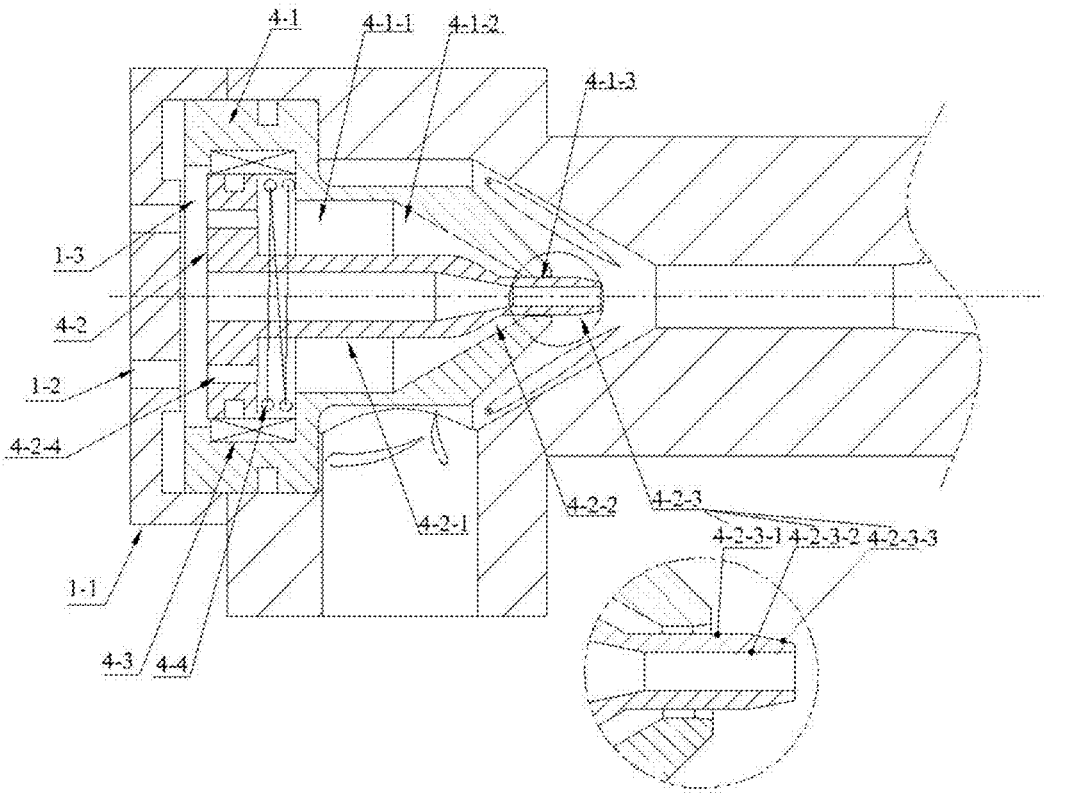
FIG. 2 is a schematic mounting diagram of a nozzle and a valve seat in Embodiment 1 of the present disclosure.

As shown in FIG. 1 and FIG. 2, the nozzle 4 includes the first-stage nozzle 4-1 and a second-stage nozzle 4-2, the first-stage nozzle 4-1 is located in the mixing cavity 1-4, and the first-stage nozzle 4-1 is mounted at the second end of the cavity 1. An inner cavity of the first-stage nozzle 4-1 is sequentially provided with a transition section 4-1-1, a tapered section 4-1-2, and a spraying section 4-1-3 according to a flow direction. The second-stage nozzle 4-2 is mounted in the transition section 4-1-1 of the first-stage nozzle 4-1 in an axially movable manner, an end of the second-stage nozzle 4-2 is inserted into the inner cavity of the first-stage nozzle 4-1, a space between a shell of the second-stage nozzle 4-2 and the inner cavity of the first-stage nozzle 4-1 is a first jet channel, and a central hole in the second-stage nozzle 4-2 is a second jet channel. An electromagnetic winding 4-3 is arranged in the first-stage nozzle 4-1, the second-stage nozzle 4-2 is made of a magnetic material, and the second-stage nozzle 4-2 slides along an inner wall of the transition section 4-1-1 by controlling a position change of the magnetic field generated by the electromagnetic winding 4-3; generally, only a flange supported at the end of the second-stage nozzle 4-2 in the transition section 4-1-1 is set to be made of the magnetic material.

A housing of the second-stage nozzle 4-2 is sequentially provided with a first housing section 4-2-1, a second housing section 4-2-2, and a guide end 4-2-3 according to the flow direction; the guide end 4-2-3 is inserted into the spraying section 4-1-3, such that a cross section of an outlet of the first jet channel is annular; an end of the guide end 4-2-3 extends out of an end surface of the spraying section 4-1-3 and extends into the mixing cavity 1-4. A unilateral clearance between the guide end 4-2-3 and the spraying section 4-1-3 is larger than a clearance in clearance fit in traditional mechanical design, such as commonly used clearance fit of H7/h6, H8/f7, G7/h6, and F8/h7. Preferably, after the guide end 4-2-3 is inserted into the spraying section 4-1-3, the unilateral clearance between the guide end 4-2-3 and the spraying section 4-1-3 is not more than 0.1 mm, which is determined according to a flow rate and a pressure required by low power output of the fuel cell in combination with the annular first jet channel.

The cavity 1 includes the housing 1-1 and the second gas inlet 1-2; and the second gas inlet 1-2 is formed in the housing 1-1 and configured to be in communication with a hydrogen supply system. Generally, a throttle valve or a valve seat with a built-in throttle valve is mounted behind the housing 1-1, and an outlet of the throttle valve is in communication with a junction port of an inlet of the second gas inlet 1-2. The other end of the second-stage nozzle 4-2 is provided with a plurality of connecting holes 4-2-4 in communication with the first jet channel; phase angles of the second gas inlet 1-2 and the connecting holes 4-2-4 are in one-to-one correspondence. Since the second-stage nozzle 4-2 has magnetism, the second-stage nozzle 4-2 can be attracted on an inner wall surface of the housing 1-1 when the electromagnetic winding 4-3 does not generate the magnetic field, such that only the first jet channel is in communication with the second gas inlet 1-2; gas jetted by the first jet channel generates a low-pressure region A in the mixing cavity, and the gas in the first gas inlet 2 can be sucked into the low-pressure region A, such that the gas in the first gas inlet 2 and gas in the second gas inlet 1-2 are mixed in the mixing cavity, and the outlet of the cavity is in communication with the stack 7. When the electromagnetic winding 4-3 generates the magnetic field to enable the second-stage nozzle 4-2 to overcome an attraction force for the attraction on the housing 3-1 and slide along the inner wall of the transition section 4-1-1, the central hole and the connecting hole 4-2-4 in the second-stage nozzle 4-2 are in communication with the second gas inlet 1-2; that is, the first jet channel and the second jet channel are in communication with the second gas inlet 1-2, the gas jetted by the first jet channel and the gas jetted by the second jet channel together generate a low-pressure region B in the mixing cavity, and the gas in the first gas inlet 2 can be sucked into the low-pressure region B, such that the gas in the first gas inlet 2 and the gas in the second gas inlet 3-2 are mixed in the mixing cavity, and the outlet of the cavity is in communication with the stack 7.

When the second-stage nozzle 4-2 is attracted on the inner wall surface of the housing 1-1 only utilizing the magnetism, a reaction force is possibly generated during gas inflow through the second gas inlet 1-2 to reversely push the second-stage nozzle 4-2, and therefore, a spring 4-4 is arranged between the flange of the second-stage nozzle 4-2 and the transition section 4-1-1; thus, the second-stage nozzle 4-2 is in close fit with the inner wall surface of the housing 1-1 by a pressure of the spring 4-4; the magnetic field generated by the electromagnetic winding 4-3 is controlled to allow the second-stage nozzle 4-2 to overcome the pressure of the spring 4-4 and slide along the inner wall of the transition section 4-1-1.

In Embodiment 1, in addition to using the electromagnetic winding 4-3 to axially move the second-stage nozzle 4-2 on the inner wall of the transition section 4-1-1, an actuator may be mounted in the housing 1-1 or at a rear end of the housing 1-1, and the actuator may be configured to axially move the second-stage nozzle 4-2 on the inner wall of the transition section 4-1-1. The actuator here can be a push rod mechanism or a lead screw mechanism or a cylinder.

The guide vanes 5 include the first fixed guide vane 5-1, the second fixed guide vane 5-2, and the rotary guide vane 5-3; a pipe where the first gas inlet 2 is located is internally provided with the first fixed guide vane 5-1 and the second fixed guide vane 5-2, and the first fixed guide vane and the second fixed guide vane have circular inlets and arc-shaped outlets. As shown in FIG. 2, an end of a left side of the first fixed guide vane 5-1 close to a wall surface of the first gas inlet 2 is provided with an inlet. The mixed gas in the first gas inlet 2 is sucked into the mixing cavity 1-4 through the first fixed guide vane 5-1 and the second fixed guide vane 5-2 in sequence or directly through the second fixed guide vane 5-2. The first fixed guide vane 5-1 is parallel to a cross section of the first gas inlet 2, a side surface of an end with smaller curvature (i.e., the back surface of the first fixed guide vane 5-1) is closer to the first gas inlet 2, and the tip of the arc shape of the outlet is close to the center of the small curvature surface of the second fixed guide vane 5-2, such that the mixed gas in the outlet of the first gas inlet 2 can be collected and guided to a flow guide surface of the second fixed guide vane 5-2 to a greater extent, and separation and backflow phenomena generated by a gas collision between an outlet of the pipe where the first gas inlet 2 is located and a first nozzle are effectively inhibited; the second fixed guide vane 5-2 is perpendicular to the cross section of the first gas inlet 2, the tip of the arc shape of the outlet of the second fixed guide vane 5-2 is close to the turning point of the tapered housing of the first-stage nozzle 4-1, the mixed gas passing through the cross section thereof is guided into the suction cavity 6, an effective mass flow rate entering the suction cavity 6 in the same time is improved, and shape design of the circular arc-shaped inlet and the tip outlet of the second fixed guide vane 5-2 is more favorable for gas flowing.

Figure 3:
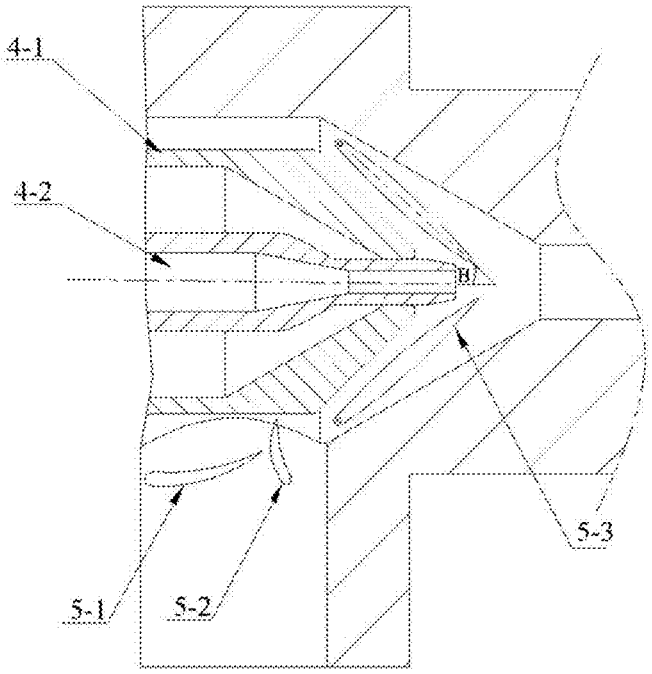
FIG. 3 is a view of an initial position of the nozzle in Embodiment 1 of the present disclosure.
Figure 4:
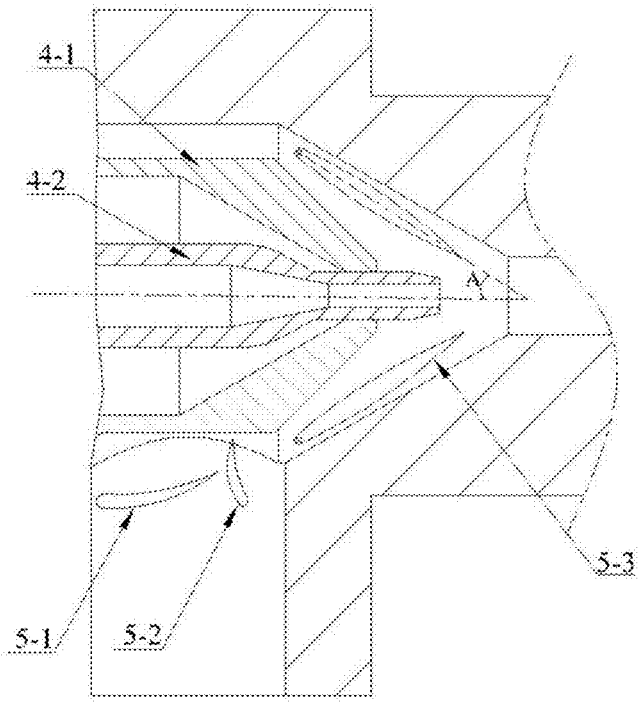
FIG. 4 is a position view of the nozzle after movement in Embodiment 1 of the present disclosure.

The rotary guide vane 5-3 is arranged in an isobaric cavity of the mixing cavity 1-4, i.e., a tapered part of the mixing cavity, namely the suction cavity 6, and the rotary guide vane 5-3 is located at the central position between the first-stage nozzle 4-1 and the isobaric wall surface of the mixing cavity 1-4 to receive and guide part of the mixed gas in the outlet of the first gas inlet 2. As shown in FIG. 3 and FIG. 4, an end of the rotary guide vane 5-3 is hinged to the wall surface of the mixing cavity 1-4, an included angle between a center line of the rotary guide vane 5-3 and a horizontal direction is defined as ω, and when the second-stage nozzle 4-2 extends out of a shortest displacement position of the first-stage nozzle 4-1, that is, the electromagnetic winding 4-3 is not electrified, only the first jet channel works, and at this point, the included angle ω between the center line (or skeleton line) of the rotary guide vane 5-3 and the horizontal direction is B; that is, when the second-stage nozzle 4-2 extends out of the shortest displacement position of the first-stage nozzle 4-1, the included angle is 42° in the embodiment; when the electromagnetic winding 4-3 is electrified and the first jet channel and the second jet channel work together, the included angle ω between the center line (or skeleton line) of the rotary guide vane 5-3 and the horizontal direction is A; that is, when the second-stage nozzle 4-2 extends out of a longest displacement position of the first-stage nozzle 4-1, the included angle is 30° in the embodiment; the rotary guide vane 5-3 includes a pair of upper and lower rotary guide vanes, structures of the two vanes are symmetrical with respect to a horizontal cross section of a center line of the two-stage jet device, such that the operation of guiding movement of a gas flow can be realized more stably; meanwhile, the hinged-end vane of the rotary guide vane 5-3-1 is arc-shaped, and the rotating-end vane of the rotary guide vane 5-3-1 is the tip, thus effectively inhibiting a backflow part of the gas in the mixing cavity.

A thickness of the first fixed guide vane 5-1 is 0.15 times to 0.18 times a nominal diameter of the first gas inlet 2; an inlet edge of the first fixed guide vane 5-1 is circular, and the outlet of the first fixed guide vane 5-1 is arc-shaped; an inner diameter of the circle at the inlet of the first fixed guide vane 5-1 is the same as the thickness of the first fixed guide vane 5-1; and an arc-shaped intersection point at the outlet of the first fixed guide vane 5-1 is located on a center line (or skeleton line) at the outlet of the first fixed guide vane 5-1. A thickness of the second fixed guide vane 5-2 is 0.6 times to 0.8 times the nominal diameter of the first gas inlet 2; an inlet edge of the second fixed guide vane 5-2 is circular, and the outlet of the second fixed guide vane 5-2 is arc-shaped; an inner diameter of the circle at the inlet of the second fixed guide vane 5-2 is the same as the thickness of the second fixed guide vane 5-2; and an arc-shaped intersection point at the outlet of the second fixed guide vane 5-2 is located on a center line (or skeleton line) at the outlet of the second fixed guide vane 5-2. The tip of the arc shape of the outlet of the first fixed guide vane 5-1 is close to the center of the curvature side of the second fixed guide vane 5-2, a distance from the tip of the arc shape of the outlet of the first fixed guide vane 5-1 to the circle center of the curvature side of the second fixed guide vane 5-2 is 0.3 times to 0.4 times the nominal diameter of the first gas inlet 2, the tip of the arc shape of the outlet of the second fixed guide vane 5-2 is close to the turning point of the tapered housing of the first-stage nozzle 4-1, and a minimum distance from the tip of the arc shape of the outlet of the second fixed guide vane 5-2 to the housing of the first-stage nozzle 4-1 is 0.03 times to 0.05 times the nominal diameter of the first gas inlet 2. A thickness of the rotary guide vane 5-3 is 0.5 times to 0.7 times a minimum diameter of the suction cavity 6; an inlet edge of the rotary guide vane 5-3 is circular, and the outlet of the second fixed guide vane 5-2 is arc-shaped and in a flat needle shape; an inner diameter of the circle at an inlet of the rotary guide vane 5-3 is the same as the thickness of the second fixed guide vane 5-2; and an arc-shaped intersection point at the outlet of the rotary guide vane 5-3 is located on a center line (or skeleton line) at the outlet of the rotary guide vane 5-3. A vertical distance from the inlet edge of the rotary guide vane 5-3 to a wall surface of the suction cavity 6 is 0.16 times to 0.2 times a minimum diameter of the suction cavity 6, a distance from the outlet of the rotary guide vane 5-3 to an inlet of the suction cavity 6 is 0.55 times to 0.6 times the minimum diameter of the suction cavity 6, and a middle section of the rotary guide vane 5-3 has smooth transition; middle sections of the first fixed guide vane 5-1 and the second fixed guide vane 5-2 have smooth transition.

Working Process:

As shown in FIG. 3, when the output power of the fuel cell is less than set power, the electromagnetic winding 4-3 is de-energized, the other end of the second-stage nozzle 4-2 is attached to the inner wall surface of the housing 1-1 by a spring force, and only the first jet channel is in communication with the second gas inlet 1-2; the gas jetted by the first jet channel generates the low-pressure region A in the mixing cavity, and the gas in the first gas inlet 2 can be sucked into the low-pressure region A, such that the gas in the first gas inlet 2 and the gas in the second gas inlet 1-2 are mixed in the mixing cavity, the outlet of the cavity is in communication with the stack, and meanwhile, since the second-stage nozzle 4-2 is located at one end close to the housing 1-1 at an initial moment, only the first jet channel works, and the rotary guide vane 5-3 is controlled to rotate to a position at an angle B towards the first-stage nozzle 4-1. At this point, an output current of the fuel cell stack is 31.3 A to 124.4 A, and a mass flow rate of the hydrogen at the second gas inlet 1-2 of the jet device is increased from 0.19 g/s to 0.49 g/s with an increase of the output current of the stack. The mass flow rate of the hydrogen is generally low, the hydrogen is accelerated when passing through the first-stage nozzle 4-1, moves along a wall surface of the extended second housing section 4-2-2, is guided to change a direction by the guide end 4-2-3, contacts and is mixed with secondary flow gas at the outlet of the guide end 4-2-3, and moves towards the center line of the jet device at a small convergence angle (12°). Meanwhile, when the secondary flow gas enters the suction cavity 6 with a gradually increased sectional area, part of the gas is in a free diffusion state and is injected into a primary flow towards a direction which is perpendicular or nearly perpendicular to the center line of the jet device. The angle B between the center line of the rotary guide vane 5-3 and the center line of the jet device is kept unchanged, the secondary flow gas in the free diffusion state can be collected using the geometric shape of the rotary guide vane 5-3, the convergence angle during movement of the gas can be combined, and an incident angle of the secondary flow gas is reasonably adjusted using the placement angle to enable the secondary flow gas to fall on a vertical plane where a mixed gas convergence point is located, thereby reducing kinetic energy loss.

As shown in FIG. 4, when the output power of the fuel cell is greater than or equal to the set power, the electromagnetic winding 4-3 is electrified, the second-stage nozzle 4-2 overcomes the spring force to move, and the first jet channel and the second jet channel are in communication with the second gas inlet 1-2; the gas jetted by the first jet channel and the gas jetted by the second jet channel together generate the low-pressure region B in the mixing cavity, and the gas in the first gas inlet 2 can be sucked into the low-pressure region B, such that the gas in the first gas inlet 2 and the gas in the second gas inlet 1-2 are mixed in the mixing cavity, and the outlet of the cavity is in communication with the stack. A region volume of the low-pressure region B is larger than a region volume of the low-pressure region A, and meanwhile, as the output power of the fuel cell increases, the end of the second-stage nozzle 4-2 moves towards the mixing cavity, and when the output power of the fuel cell approaches output power at a full-load working condition, the rotary guide vane 5-3 is controlled to rotate away from the first-stage nozzle 4-1 to a position at an angle A, and at this point, the output current of the fuel cell stack is 124.4 A to 559.8 A, and the mass flow rate of the hydrogen at the second gas inlet 1-2 of the jet device is increased from 0.49 g/s to 2.44 g/s with the increase of the output current of the stack. With the increase of the mass flow rate of the hydrogen, the second-stage nozzle 4-2 horizontally moves towards the outlet of the first-stage nozzle 4-1 at a constant velocity, such that the pure hydrogen can enter the nozzle 4 after fully mixed at a front end, and stability of gas supply under a high output current is guaranteed. Meanwhile, the gas passes through the first-stage nozzle 4-1 and the second-stage nozzle 4-2, two gas flows at the outlets of the nozzles converge at the outlet of the second-stage nozzle 4-2, and the convergence point of the two gas flows horizontally moves towards a same direction with the horizontal movement of the second-stage nozzle 4-2 caused by the increase of the mass flow rate of the hydrogen. Since a position of the first-stage nozzle 4-1 and the cavity 3-1 are kept unchanged, and the sectional area of the suction cavity 6 is gradually increased, part of the secondary flow gas is in the free diffusion state and is injected into the primary flow towards the direction which is perpendicular or nearly perpendicular to the center line of the jet device. Contact of the two gas flows changes a flow direction of the mixed gas. At this point, the rotary guide vane 5-3 is controlled to rotate by a magneto, so as to reduce the included angle between the center line of the rotary guide vane and the center line of the jet device from the angle B to the angle A. With a change of the mass flow rate of the hydrogen, during the horizontal movement of the second-stage nozzle 4-2, the center line of the rotary guide vane 5-3 is kept parallel to a plane of the guide end 4-2-3, the secondary flow gas in the free diffusion state can be collected through the geometric shape of the rotary guide vane 5-3, and the incident angle of the secondary flow gas can be reasonably adjusted according to the angle of the rotary guide vane 5-3, so as to enable a falling point of the secondary flow gas to move with movement of the convergence point of the mixed gas, thereby reducing the energy loss.

An outer contour of the first housing section 4-2-1 is cylindrical, an outer contour of the second housing section 4-2-2 is conical, and the spraying section 4-1-3 is a taper hole and is configured to form a divergent annular outlet at the outlet of the first jet channel.

Figure 5:
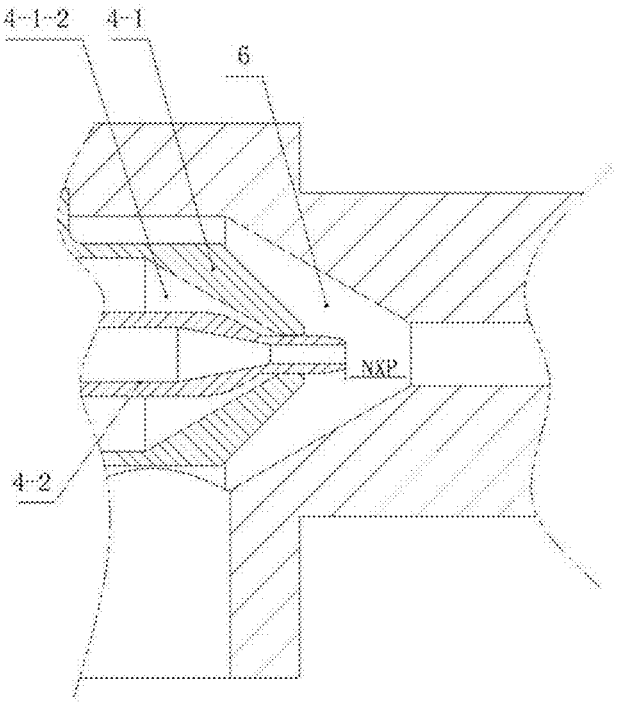
FIG. 5 is a specific position view of an NXP distance in the present disclosure.

The end of the second-stage nozzle 4-2 extends out of the end surface of the first-stage nozzle 4-1 and extends into the mixing cavity 1-4, such that a vortex is prevented from being generated at the outlet of the nozzle 4, so as to prevent an unstable phenomenon of a vortex, oscillation, or the like, caused by simultaneous mixing of multiple gas flows at a front end of a multi-channel jet device. As shown in FIG. 5, a distance from the end of the second-stage nozzle extending out of the end surface of the first-stage nozzle to a cross section of an outlet of the suction cavity 6 is NXP, and when NXP is $0.8D_m$ to $1.1D_m$, an entrainment effect and a gas flow mixing effect are optimal. The cross section at the outlet of the suction cavity 6 can be understood as an interface between the outlet of the isobaric cavity of the mixing cavity 1-4 and an isovolumetric cavity of the mixing cavity 1-4. $D_m$ is a nominal diameter of the isovolumetric cavity of the mixing cavity 1-4.

An outer contour surface of the guide end 4-2-3 is sequentially provided with a first flow guide surface 4-2-3-1 and a third flow guide surface 4-2-3-3 according to the flow direction, smooth transition exists between a side of the first flow guide surface 4-2-3-1 and the second housing section 4-2-2, and the gas in the outlet of the first jet channel is kept horizontally advancing at a high velocity by applying a supporting force to the gas in the outlet of the first jet channel; an inner hole of the guide end 4-2-3 at the outlet of the second jet channel is provided with a second flow guide surface 4-2-3-2, and the gas in the outlet of the second jet channel is kept horizontally advancing at a high velocity before mixed in the two jet channels by radially shunting and constraining the gas in the outlet of the second jet channel; the third flow guide surface 4-2-3-3 is a tapered conical surface, and the third flow guide surface 4-2-3-3 applies a supporting force to mixed gas formed by the gas in the outlet of the first jet channel and jet gas, and the supporting force is perpendicular to a direction of movement of the mixed gas along a wall, such that the mixed gas is kept advancing at a high velocity.

Embodiment 2

Figure 6:
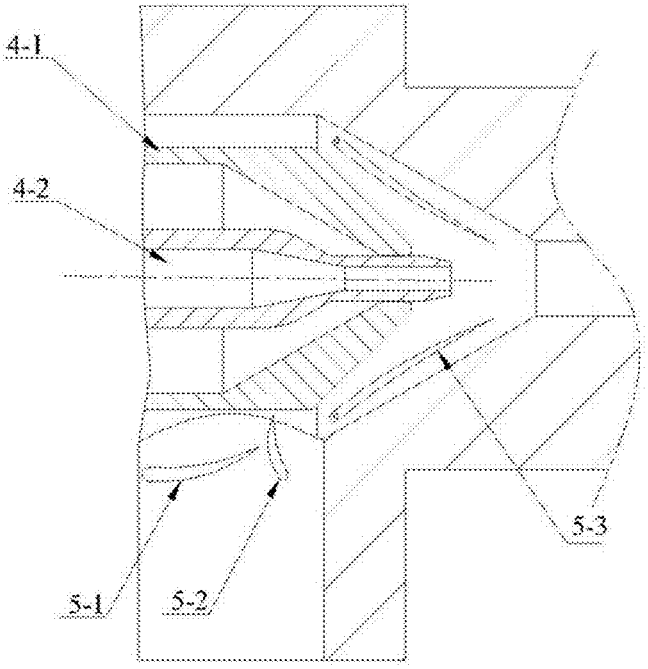
FIG. 6 is a schematic mounting diagram of a nozzle and a valve seat in Embodiment 2 of the present disclosure.

In Embodiment 2, as shown in FIG. 6, based on Embodiment 1, a tangent angle of the arc shape of the outlet of the rotary guide vane 5-3 is the same as a tangent angle of the arc shape of the outlet of the second fixed guide vane 5-2. A space of the suction cavity 6 is a tapered space, and a flow velocity of the gas in the outlet of the first gas inlet 2 is increased, such that total kinetic energy can be increased when the primary flow and the secondary flow converge in the isobaric mixing cavity; the rotary guide vane 5-3 is arranged and can be in cooperation with a moving distance of the guide end 4-2-3 on the second-stage nozzle 4-2, such that the secondary flow gas enters the primary flow at a better angle, and energy dissipation during convergence is reduced.

Embodiment 3

Figure 7:
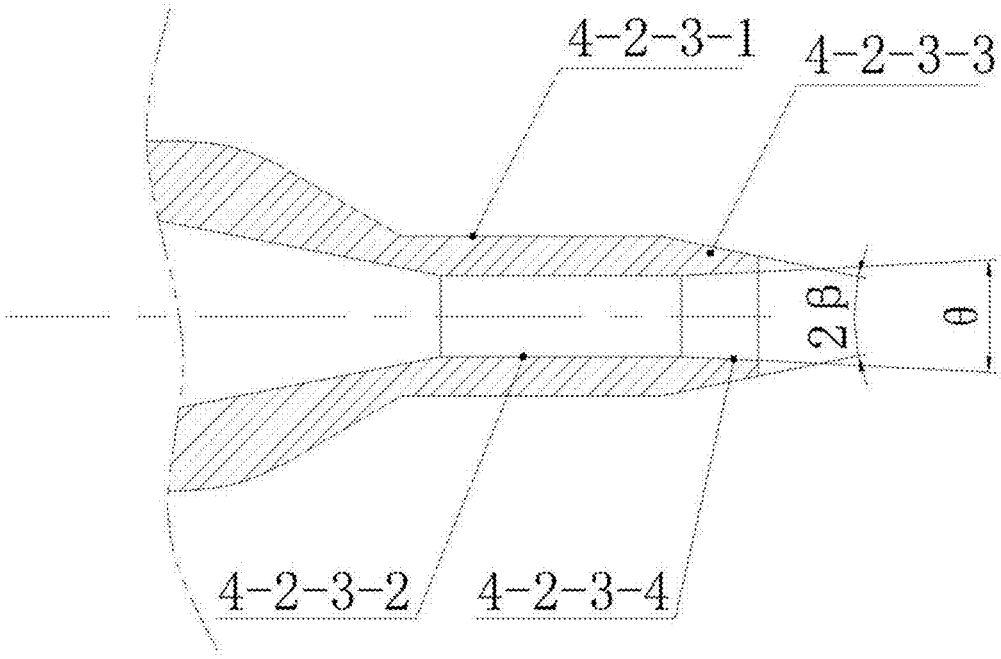
FIG. 7 is a structural view of a second-stage nozzle in Embodiment 3 of the present disclosure.

In Embodiment 3, as shown in FIG. 7, based on Embodiment 1 or Embodiment 2, the second housing section 4-2-2 is located in the tapered section 4-1-2, and the second housing section 4-2-2 and the tapered section 4-1-2 have conical surfaces with same taper. An outlet of the second flow guide surface 4-2-3-2 is provided with a diffusion section 4-2-3-4, and the diffusion section 4-2-3-4 is in a conical shape or an arc shape with a gradually changed curved surfaces. A taper angle θ of an inner contour of the diffusion section 4-2-3-4 may optionally be 5° to 10°. A taper angle of the third flow guide surface 4-2-3-3 is 2β, and the taper angle 2B of the third flow guide surface 4-2-3-3 is greater than the taper angle θ of the inner contour of the diffusion section 4-2-3-4.

Simulation Analysis:

Working condition setting: in order to describe beneficial effects of the structure of the present disclosure compared with the prior art, a single-stage jet mode and a two-stage jet mode are simulated by adopting a uniform working condition. Under a single-stage jet condition, only the first jet channel is opened, and at this point, the output current of the stack of the fuel cell is 62.2 A, and the pure hydrogen entering from the second gas inlet has a mass flow rate of 0.19 g/s and a normal temperature of 25° C. The high-temperature mixed gas entering from the first gas inlet has an absolute pressure of 131 kPa and an average temperature of 67° C., and by volume fraction, the mixed gas has a composition of $H_2$:$N_2$:$H_2O$=90%:5%:5%. Under a two-stage jet condition, the first jet channel and the second jet channel are opened simultaneously, and at this point, the output power of the stack of the fuel cell is 155.5 A, and the pure hydrogen entering from the second gas inlet has a mass flow rate of 0.49 g/s and a normal temperature of 25° C. The high-temperature mixed gas entering from the first gas inlet has an absolute pressure of 206 kPa and an average temperature of 71° C., and by volume fraction, the mixed gas has a composition of $H_2$:$N_2$:H20-85%:7%:8%.

Figure 8:
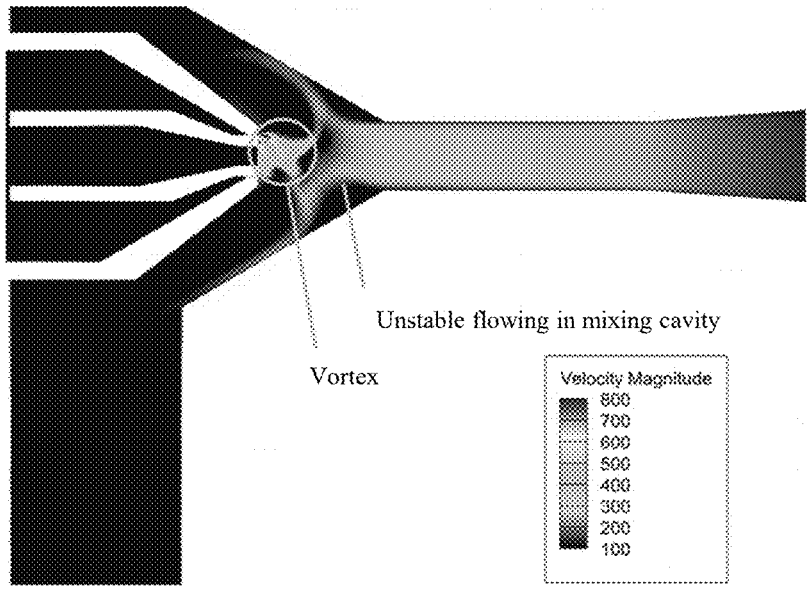
FIG. 8 is a simulation diagram of a two-stage jet device in the prior art in single-stage working.

As shown in FIG. 8, in a single-stage jet of the prior art, since a flow velocity at the outlet of the second jet channel of the second-stage nozzle 4-2 is high, in a high-velocity flow near the outlet of the second jet channel, part of the fluid falls off due to slow flowing at a velocity boundary layer to form a vortex, and when a working time is long, vortex cores have increased volumes, affect the high-velocity flow, reduce kinetic energy thereof, and are combined to enter the mixing cavity in an unstable flow form while reducing an entrainment capacity, thereby forming phenomena of shock waves, or the like, affecting a diffusion effect and an outlet pressure, further reducing a supply pressure entering the stack, and affecting a working efficiency of a stack system.

Figure 9:
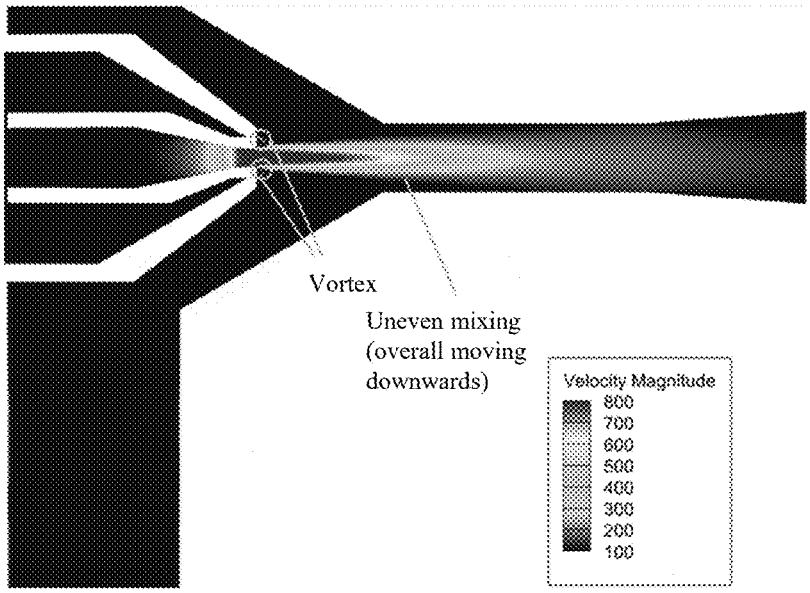
FIG. 9 is a simulation diagram of the two-stage jet device in the prior art in two-stage working.

As shown in FIG. 9, in a two-stage jet of the prior art, since the first jet channel and the second jet channel are simultaneously opened, the two inlet gas flows are mutually mixed, thus resulting in energy loss and meanwhile reducing kinetic energy of the high-velocity flow. An entrainment efficiency is influenced, and unstable phenomena of shock waves, oscillation, or the like, in the mixing cavity are caused and finally move into a diffusion pipe to influence the diffusion effect and the outlet pressure of the jet device, thereby influencing the working efficiency of the fuel cell stack system.

Figure 10:
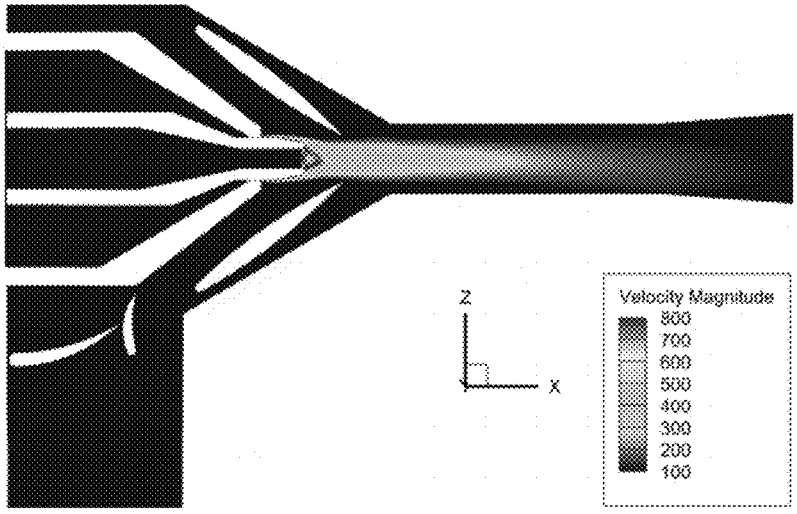
FIG. 10 is a simulation diagram of the two-stage jet device according to Embodiment 1 of the present disclosure in single-stage working.
Figure 11:
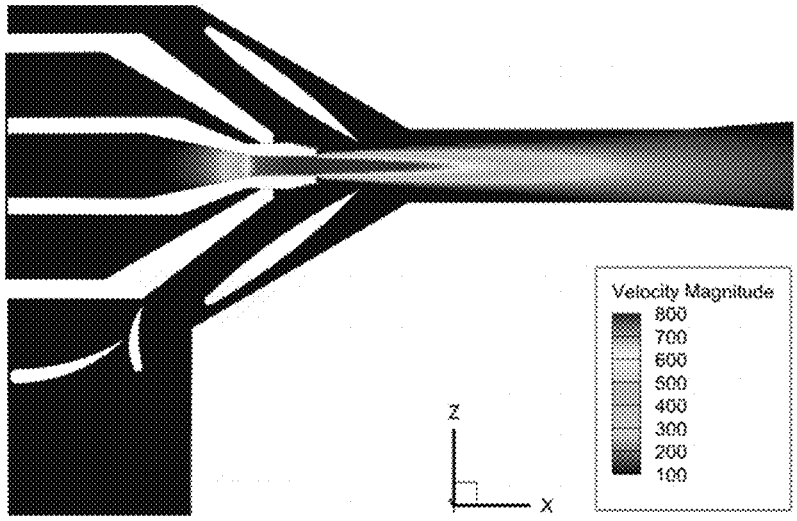
FIG. 11 is a simulation diagram of the two-stage jet device according to Embodiment 1 of the present disclosure in two-stage working.
Figure 12:
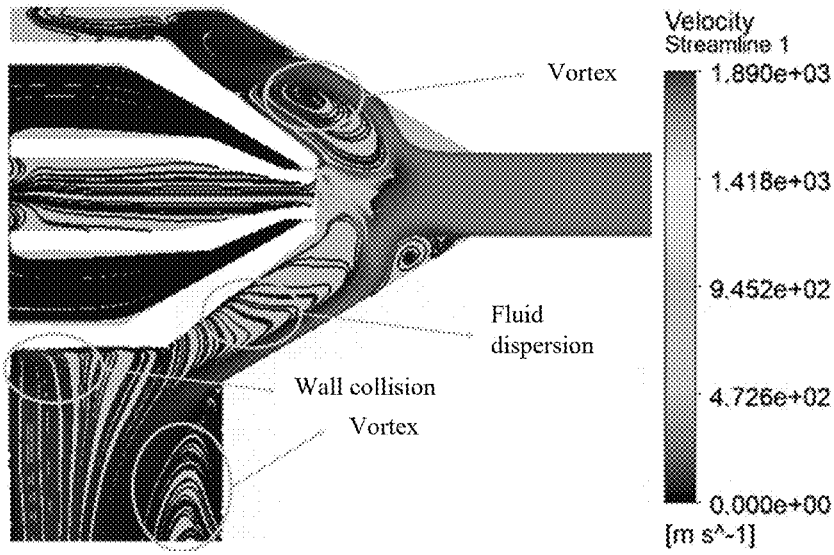
FIG. 12 is a flow path line view of the two-stage jet device in the prior art in the single-stage working.

Taking the structure of Embodiment 1 as an example, as shown in FIG. 10, the end of the second-stage nozzle 4-2 extends out of the end surface of the first-stage nozzle 4-1, and when NXP is $1.1D_m$, it can be seen in the drawing that by guiding the high-velocity flow gas at the outlet of the first jet channel, the vortex and the instable gas flow near the outlet of the nozzle in FIG. 9 are avoided, and in the present disclosure, the gas flow is mixed at a position close to the outlet of the isobaric cavity, and enters the isovolumetric mixing cavity in a stable mixed flow form; as shown in FIG. 12, the end of the second-stage nozzle extends out of the end surface of the first-stage nozzle, and when NXP is $0.8D_m$, the unstable phenomena of the vortex, the oscillation, or the like, caused by the simultaneous mixing of the multiple gas flows at the front end of the multi-channel jet device are prevented. An outer side included angle of the guide nozzle is reasonably set, such that the jet gas is guided to advance along the wall, and evenly mixed with the gas at the outlet of the first jet channel at a relatively high velocity. Meanwhile, by reducing a radial velocity at a tip of the guide nozzle, the mixing process of the gas in the outlet of the second jet channel, the gas in the outlet of the first jet channel, and the jet gas is moderated, the energy loss is reduced, the gas is uniformly mixed by utilizing gas shear stress, and the gas stably enters the mixing cavity at the high velocity and is stably supplied to the stack. It can be seen in the drawing that the high-velocity flow gas in the first jet channel and the second jet channel realizes smooth transition and confluence at the outlet of the second-stage nozzle, and an uneven mixed flow caused by the vortex generated near the outlet of the nozzle in FIG. 8 and FIG. 9 is avoided. Meanwhile, the second jet channel is lengthened, and compared with FIG. 8 and FIG. 9, a whole high-velocity region of the gas at the outlet thereof is shifted to a position closer to the outlet of the isobaric cavity, and the kinetic energy loss is reduced.

Figure 13:
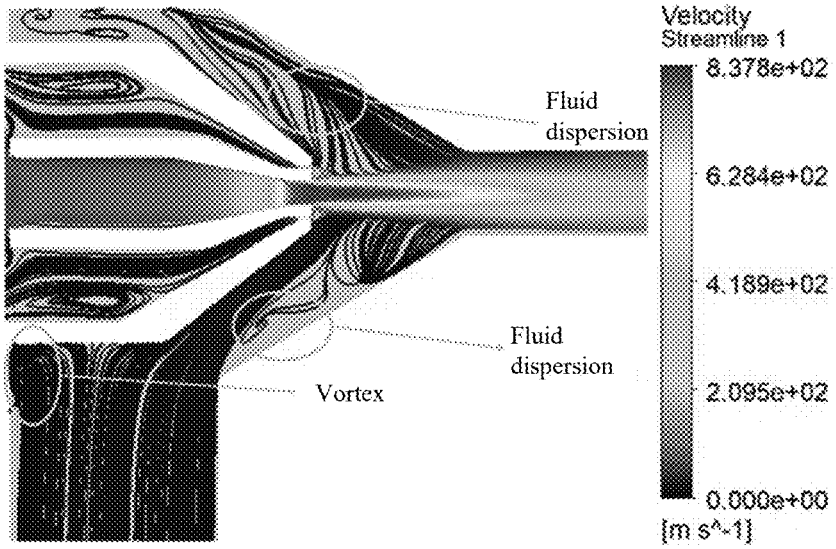
FIG. 13 is a flow path line view of the two-stage jet device in the prior art in the two-stage working.

Meanwhile, for the purpose of increasing a circulation efficiency, on existing structural design of the two-stage jet device, the nozzle 4 is intersected with the first gas inlet 2, and a flow area is reduced. As shown in FIG. 12 and FIG. 13, before entering the mixing cavity 1-4, part of the gas of the first gas inlet 2 collides in the housing 1-1 to form the vortex, thus reducing an effective entrainment amount of the gas entering the first gas inlet 2; meanwhile, due to the perpendicular relationship of the above geometric structure, when entering the mixing cavity 1-4, the gas entering from the first gas inlet 2 directly enters the high-velocity flow at the outlet of the nozzle 4 at an approximately perpendicular angle, and the two gas flows have a strong impact, such that circumferential gas flow fluctuation is generated while large kinetic energy loss is caused, resulting in an unstable mixed flowing phenomenon at the front end of the mixing cavity. The influence of the gas flow fluctuation is transmitted into the isovolumetric mixing cavity 1-4, the energy mixing process of the primary flow gas and the secondary flow gas cannot be completed, unstable gas moves to influence the diffusion effect and the outlet pressure of the jet device, and thus influence the supply pressure of the stack, and an optimal output efficiency of each working condition point of the fuel cell stack system cannot be achieved.

Figure 14:
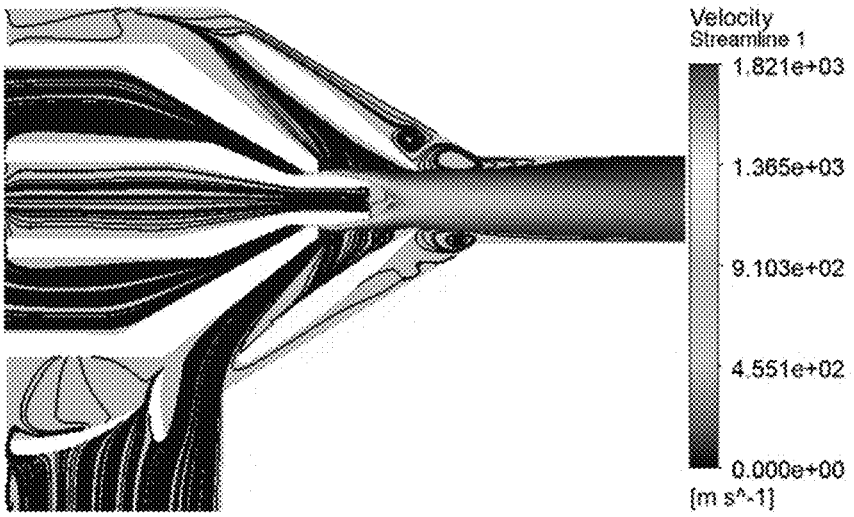
FIG. 14 is a flow path line view of the two-stage jet device according to Embodiment 1 of the present disclosure in the single-stage working.
Figure 15:
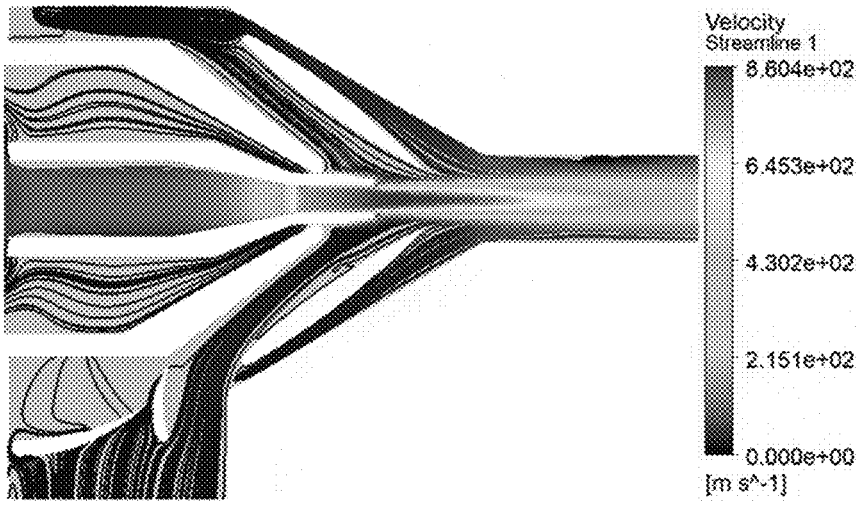
FIG. 15 is a flow path line view of the two-stage jet device according to Embodiment 1 of the present disclosure in the two-stage working.

Taking the structure of Embodiment 1 as an example, as shown in FIG. 2, the inlet of the first gas inlet 2 is provided with two fixed guide vanes to achieve a gas flow guide effect, and it can be seen in the drawing that the gas entering from the first gas inlet 2 alleviates or avoids the vortex phenomenon of a pipe wall near the first nozzle in FIG. 12 and FIG. 13; as shown in FIG. 14 and FIG. 15, the gas entering the first gas inlet 2 enters the second fixed guide vane 5-2 along the first fixed guide vane 5-1 or enters the suction cavity 6 along the second fixed guide vane 5-2; the gas which enters the suction cavity 6 and is separated from the wall surface can smoothly enter the high-velocity primary flow along the rotary guide vane 5-3, and a mixing angle of the secondary flow and the primary flow is improved. The phenomenon of almost perpendicular entering of part of the secondary flow gas in the suction cavity 6 in FIG. 12 and FIG. 13 is improved, and compared with FIG. 12 and FIG. 13, the mixed gas of the primary flow and the secondary flow is integrally closer to the outlet of the isobaric cavity, and the kinetic energy loss is reduced. The primary flow here is the gas jetted from the nozzle, and the secondary flow is the gas entering from the first gas inlet 2.

It should be understood that although the specification is described in terms of various embodiments, not every embodiment only includes an independent technical solution, and such description of the specification is for clarity only; those skilled in the art should take the specification as a whole, and the technical solutions in various embodiments may also be appropriately combined to form other embodiments that may be understood by those skilled in the art.

The series of detailed descriptions listed above are only specific descriptions for the feasible embodiments of the present disclosure, and are not intended to limit the protection scope of the present disclosure, and all equivalent embodiments or modifications made without departing from the technical spirit of the present disclosure shall be included within the protection scope of the present disclosure.

What is claimed is:

1. A two-stage jet device with a flow guide structure, comprising a cavity and a nozzle, wherein a first end of the cavity is provided with an outlet, a second end of the cavity is provided with a first gas inlet and a second gas inlet, and a mixing cavity in communication with the first gas inlet is formed in the cavity; the nozzle comprises a first-stage nozzle and a second-stage nozzle, the first-stage nozzle is located in the mixing cavity, and the first-stage nozzle is mounted at the second end of the cavity; the second-stage nozzle is mounted in the first-stage nozzle in an axially movable manner, an end of the second-stage nozzle is inserted into an inner cavity of the first-stage nozzle, a space between a shell of the second-stage nozzle and the inner cavity of the first-stage nozzle is a first jet channel, and a central hole in the second-stage nozzle is a second jet channel; by moving the second-stage nozzle, the second gas inlet is in communication with the first jet channel, or the second gas inlet is in communication with the first jet channel and the second jet channel;

the two-stage jet device further comprising guide vanes, wherein the guide vanes are arranged in the first gas inlet and a suction cavity of the mixing cavity respectively, one of the guide vanes in the suction cavity is rotatable, and a control system controls a rotation angle of the one of the guide vanes in the suction cavity according to a position of the second-stage nozzle.

2. The two-stage jet device with the flow guide structure according to claim 1, wherein the guide vanes comprise a first fixed guide vane, a second fixed guide vane, and a rotary guide vane; the first fixed guide vane and the second fixed guide vane are arranged in the first gas inlet, the first fixed guide vane is parallel to a cross section of the first gas inlet, and the second fixed guide vane is perpendicular to the cross section of the first gas inlet; the rotary guide vane is located between the first-stage nozzle and the suction cavity, an end of the rotary guide vane is hinged to a wall surface of the suction cavity, and the rotary guide vane is rotatable by an external force; when the second-stage nozzle moves to communicate the second gas inlet with the first jet channel and the second jet channel, the control system controls the rotary guide vane to rotate, to reduce an included angle between the rotary guide vane and a horizontal direction.

3. The two-stage jet device with the flow guide structure according to claim 2, wherein a thickness of the first fixed guide vane is 0.15 times to 0.18 times a nominal diameter of the first gas inlet.

4. The two-stage jet device with the flow guide structure according to claim 1, wherein the end of the second-stage nozzle extends out of an end surface of the first-stage nozzle to prevent a vortex from being generated at an outlet of the nozzle; a distance from the end of the second-stage nozzle extending out of the end surface of the first-stage nozzle to a cross section of an outlet of the suction cavity is NXP, NXP is $0.8D_m$ to $1.1D_m$, and $D_m$ is a nominal diameter of the outlet of the suction cavity.

5. The two-stage jet device with the flow guide structure according to claim 4 wherein a housing of the second-stage nozzle is sequentially provided with a first housing section, a second housing section, and a guide end according to a flow direction; the guide end is inserted into the first-stage nozzle, such that a cross section of an outlet of the first jet channel is annular; an end of the guide end extends out of the end surface of the first-stage nozzle; an outer contour surface of the guide end is sequentially provided with a first flow guide surface and a third flow guide surface according to the flow direction, a smooth transition exists between a side of the first flow guide surface and the second housing section, and gas in the outlet of the first jet channel is kept horizontally advancing by applying a supporting force to the gas in the outlet of the first jet channel; an inner hole of the guide end at an outlet of the second jet channel is provided with a second flow guide surface, and gas in the outlet of the second jet channel is kept horizontally advancing before being mixed in the first jet channel and the second jet channel by radially shunting and constraining the gas in the outlet of the second jet channel; the third flow guide surface is a tapered conical surface, and mixed gas formed by the gas in the outlet of the first jet channel and gas entering the mixing cavity obliquely enters the gas in the outlet of the second jet channel along the third flow guide surface, to moderate mixing of the mixed gas and the gas in the outlet of the second jet channel.

6. The two-stage jet device with the flow guide structure according to claim 5, wherein an inclination angle of the third flow guide surface increases with an axial length of the guide end; and an included angle between the third flow guide surface and an axial direction is 8 degrees to 15 degrees.

7. The two-stage jet device with the flow guide structure according to claim 5, wherein a diffusion section is provided at an outlet of the second flow guide surface, a taper of an inner contour of the diffusion section is a positive taper θ, and a taper of the third flow guide surface is larger than the taper of the inner contour of the diffusion section.

* * * * *